US005421104A

United States Patent [19]

Talley

[11] Patent Number: 5,421,104

[45] Date of Patent: Jun. 6, 1995

[54] SCREW ON SHOE HEEL REPLACEMENT SYSTEM

[76] Inventor: Chester I. Talley, 3208 W. 84th Pl., Apt. 4, Inglewood, Calif. 90305

[21] Appl. No.: 96,306

[22] Filed: Jul. 26, 1993

[51] Int. Cl.[6] ..... A43B 21/36

[52] U.S. Cl. ..... 36/42; 36/36 R

[58] Field of Search ..... 36/36 R, 36 A, 36 B, 36/36 C, 41, 42, 34 R, 15, 132, 114, 134, 100, 72 R, 73, 75 R, 76 R

[56] References Cited

U.S. PATENT DOCUMENTS

| | | | |
|---|---|---|---|
| 118,839 | 9/1871 | Bray | 36/42 |
| 372,435 | 11/1887 | Sommerfield | 36/42 |
| 1,778,089 | 10/1930 | Pomerantz | 36/36 R |
| 1,821,878 | 9/1931 | Bradley | 36/36 R |
| 2,486,704 | 11/1949 | Cameron | 36/36 R |
| 4,429,474 | 2/1984 | Metro | 36/36 A |

*Primary Examiner*—Bryon P. Gehman
*Assistant Examiner*—Thomas P. Hilliard

[57] ABSTRACT

A screw on shoe heel enables anyone to quickly and easily replace their own worn shoe heels using only a simple screwdriver without the need for taking the shoes to a shoe repair professional. The screw on heel has a set of holes running therethrough. The shoe has an arch support plate traversing its length and both the shoe and the support plate have a set of screw holes (corresponding to the holes in the screw on heel) in the heel area. The screw holes in the support plate are threaded. A cushion covers the arch support plate to keep the shoe comfortable to wear. When the heel is screwed onto the shoe, the heads of the screws are recessed into the heel shielding them from contact with the ground.

2 Claims, 5 Drawing Sheets

SCREW ON SHOE HEEL REPLACEMENT SYSTEM

BACKGROUND OF THE INVENTION

1. Field of the Invention

The present invention relates generally to shoes, and more particularly, to a shoe having a heel especially adapted to screw onto the heel.

2. Description of the Prior Art

The replacement of shoe heels is very common. Unfortunately, such heel replacement typically must be done by a shoe repair professional. Shoes with detachable heels are known in the prior art (see for example U.S. Pat. Nos. 4,745,693 and 3,782,010). Unfortunately, the structures and procedures for heel removal in the prior art is typically quite complex.

What is needed is a simple heel removal and replacement system which can be used by anybody to quickly and easily remove and replace worn heels on their shoes.

Thus, while the foregoing body of prior art indicates it to be well known to repair worn shoe heels by taking them to shoe professionals, the provision of a more simple and cost effective device is not contemplated. Nor does the prior art described above teach or suggest a screw on shoe heel device which may be used by individuals to quickly and easily replace worn heels on their shoes without having to take the shoes to a shoe repair professional. The foregoing disadvantages are overcome by the unique screw on shoe heel of the present invention as will be made apparent from the following description thereof. Other advantages of the present invention over the prior art also will be rendered evident.

SUMMARY OF THE INVENTION

To achieve the foregoing and other advantages, the present invention, briefly described, provides a screw on shoe heel which enables anyone to quickly and easily replace their own worn shoe heels using only a simple screwdriver without the need for taking the shoes to a shoe repair professional. The screw on heel has a set of holes running therethrough. The shoe has an arch support plate traversing its length and both the shoe and the support plate have a set of screw holes (corresponding to the holes in the screw on heel) in the heel area. The screw holes in the support plate are threaded. A cushion covers the arch support plate to keep the shoe comfortable to wear. When the heel is screwed onto the shoe, the heads of the screws are recessed into the heel shielding them from contact with the ground.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new screw on shoe heel which has all of the advantages of the prior art and none of the disadvantages.

It is another object of the present invention to provide a new screw on shoe heel which may be easily and efficiently manufactured and marketed.

It is a further objective of the present invention to provide a new screw on shoe heel which is of durable and reliable construction.

An even further object of the present invention is to provide a new screw on shoe heel which is susceptible of a low cost of manufacture with regard to both materials and labor, and which accordingly is then susceptible of low prices of sale to the consuming public, thereby making such screw on shoe heel available to the buying public.

Still yet a further object of the present invention is to provide a new screw on shoe heel replacement system in which worn shoe heels can be quickly and easily replaced by virtually anybody using only a screwdriver.

It is still a further object of the present invention is to provide a new screw on shoe heel which can be removed and replaced without taking the shoe to a shoe professional.

Still a further object of the present invention is to provide a new screw on shoe heel including means for holding a powder bag containing powdered shoe deodorant or the like within a hollow heel.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved screw on shoe heel embodying the principles and concepts of the present invention will be described.

Figure 1:
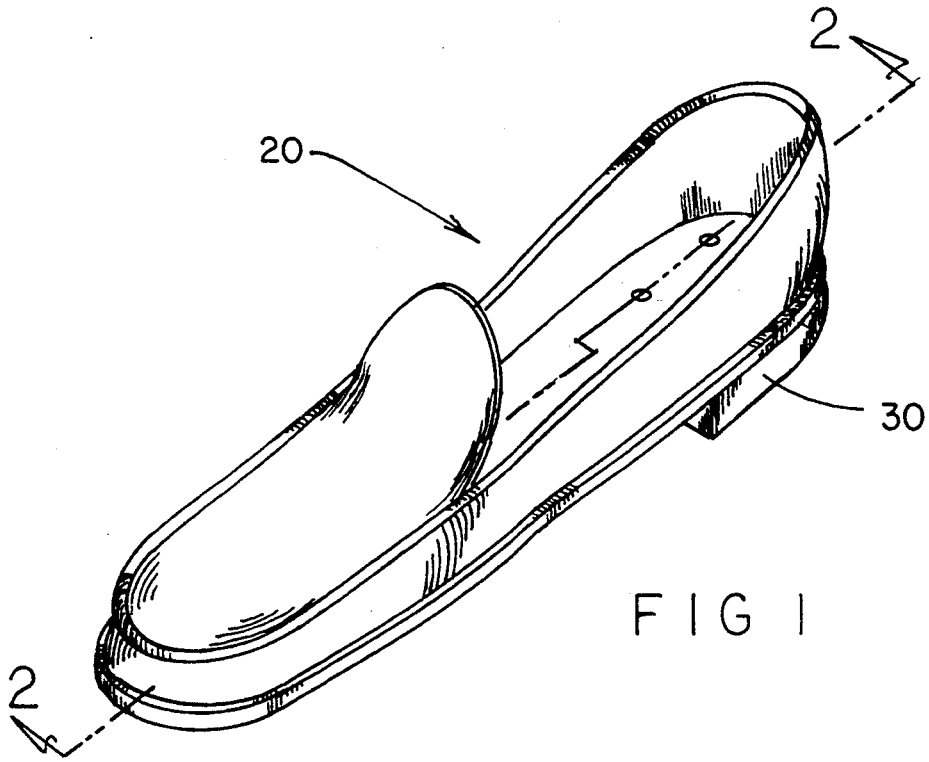
FIG. 1 is a perspective view showing the first preferred embodiment of the screw on shoe heel of the present invention.
Figure 2:
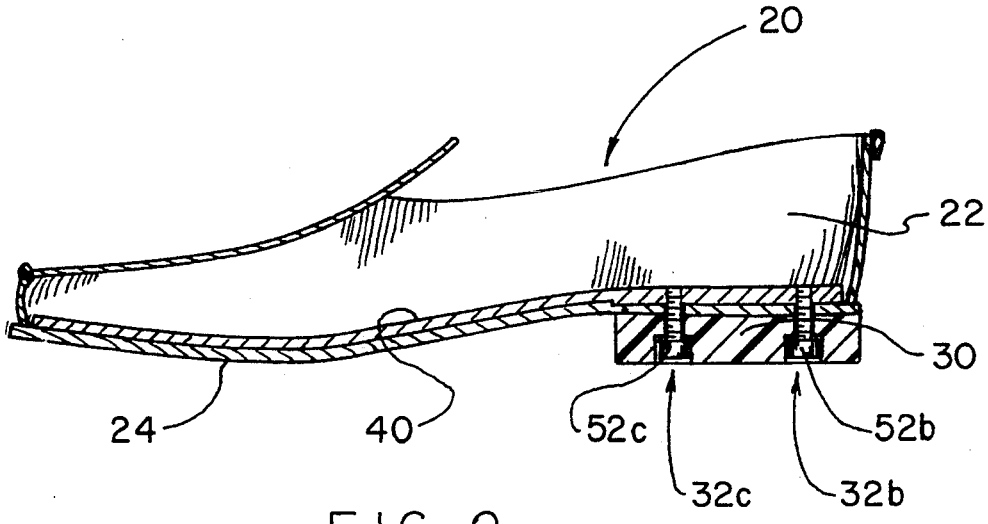
FIG. 2 is a cross-sectional elevational view of the screw on shoe heel of the present invention taken along line 2—2 of FIG. 1.
Figures 3, 4:
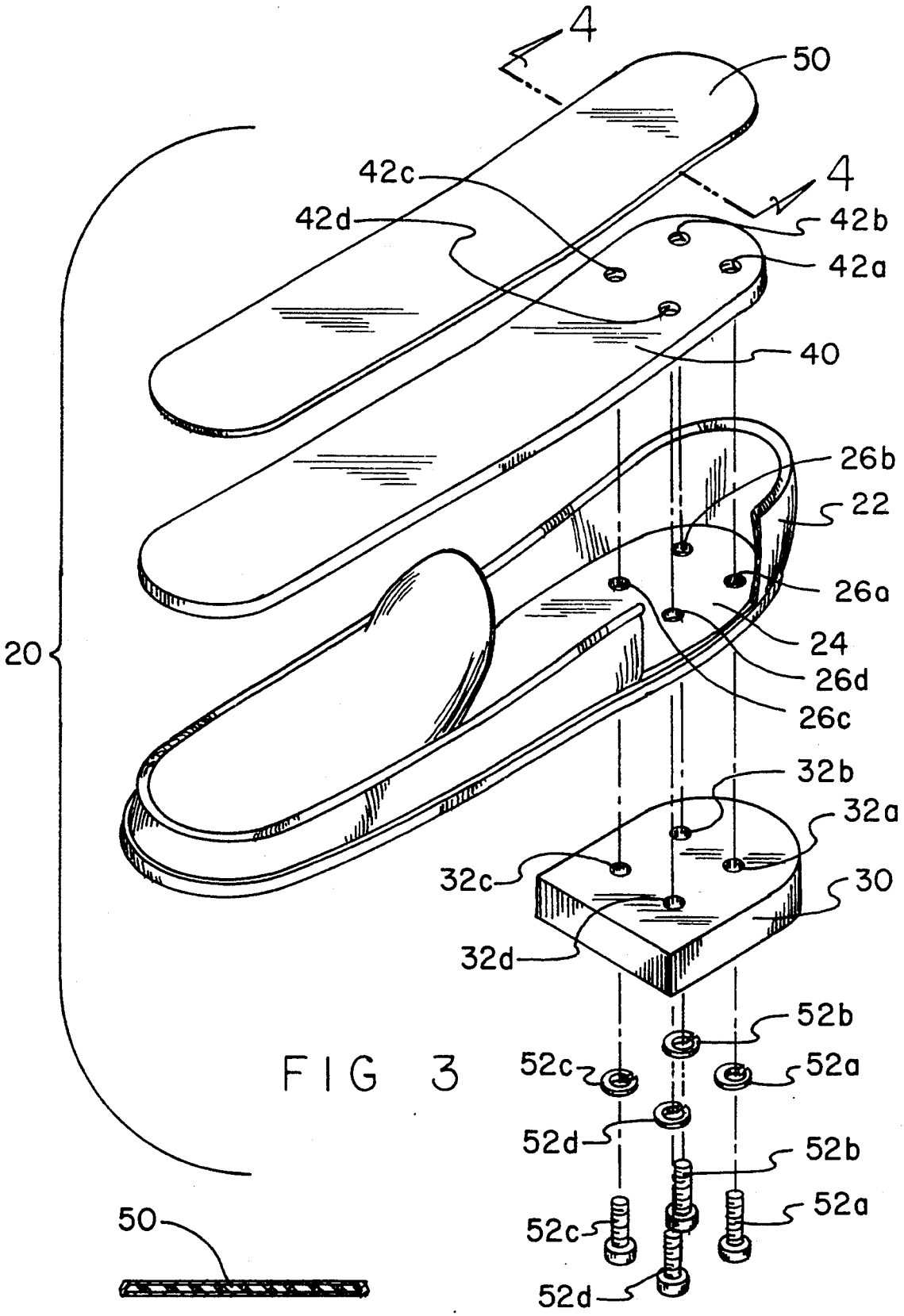
FIG. 3 is a perspective view of the screw on shoe heel of FIGS. 1 and 2 with its parts separated.
FIG. 4 is a cross sectional view of the cushion shown in FIG. 3 taken along line 4—4 thereof.
Figure 5:
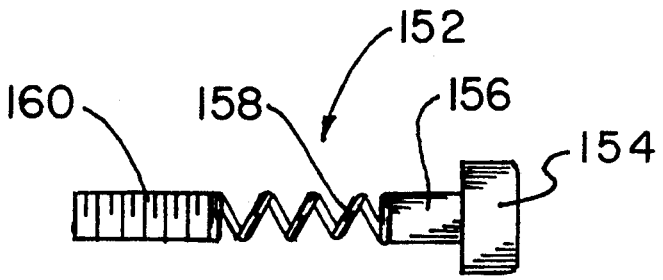
FIG. 5 is a side view of a screw for use in a second preferred embodiment of the present invention all in accordance with the present invention.
Figure 6:
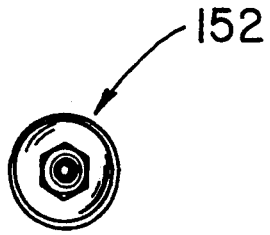
FIG. 6 is an end view of the screw of FIG. 5 in accordance with the present invention.
Figure 7:
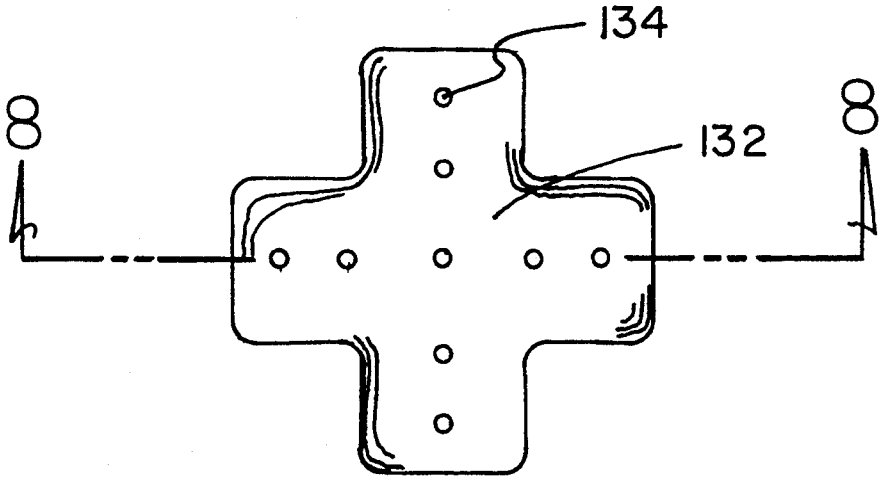
FIG. 7 is a perspective view from above of a plus-sign shaped powder bag for use in the second preferred embodiment of the present invention.
Figure 8:
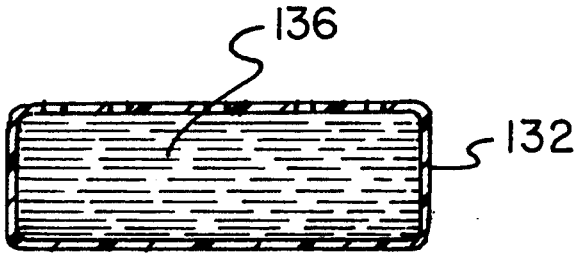
FIG. 8 is a side cross sectional view of the powder bag of FIG. 7 taken along lines 8—8 thereof.

Turning initially to FIGS. 1-3 (particularly FIG. 3), there is shown a first exemplary embodiment of a shoe utilizing a screw-on shoe heel in accordance with the present invention, the shoe generally designated by the reference numeral 20. In its preferred form, shoe 20 comprises generally a main body 22 with a sole 24. The sole 24 has screw holes 26*a*, 26*b*, 26*c*, 26*d* (preferably four as shown).

A heel 30 has screw holes 32*a*, 32*b*, 32*c*, 32*d* (again preferably four) drilled to correspond with the screw holes 26*a*, 26*b*, 26*c*, 26*d* through sole 30. The screw holes 32*a*, 32*b*, 32*c*, 32*d* have wide sections 34*a*, 34*b*, 34*c*, 34*d* (only 34*b* and 34*c* can be seen in FIG. 2).

An arch support plate 40 having preferably four correspondingly drilled threaded screw holes 42*a*, 42*b*, 42*c*, 42*d* is constructed to fit snugly within the shoe above the sole 24. The arch support plate 40 is shaped substantially similar to the sole 24 of the shoe 20 so as to extend coextensively thereover to substantially and completely cover the sole within the shoe.

A soft cushion 50 is constructed to fit snugly within the shoe 20 above the arch support plate 40.

A set of screws 52*a*, 52*b*, 52*c* and 52*d* can be used to hold the parts of the shoe together. Washers 54*a*, 54*b*, 54*c* and 54*d* which fit snugly around the screws can also be used.

Removal and replacement of the heel 30 of the shoe 20 in accordance with the present invention can be done very quickly and easily. The screws 52*a*, 52*b*, 52*c* and 52*d* are simply unscrewed from the shoe and the heel 30 removed. A new heel 30 is obtained and screwed onto the shoe by screwing in the original screws 52*a*, 52*b*, 52*c* and 52*d*.

Figures 9, 10:
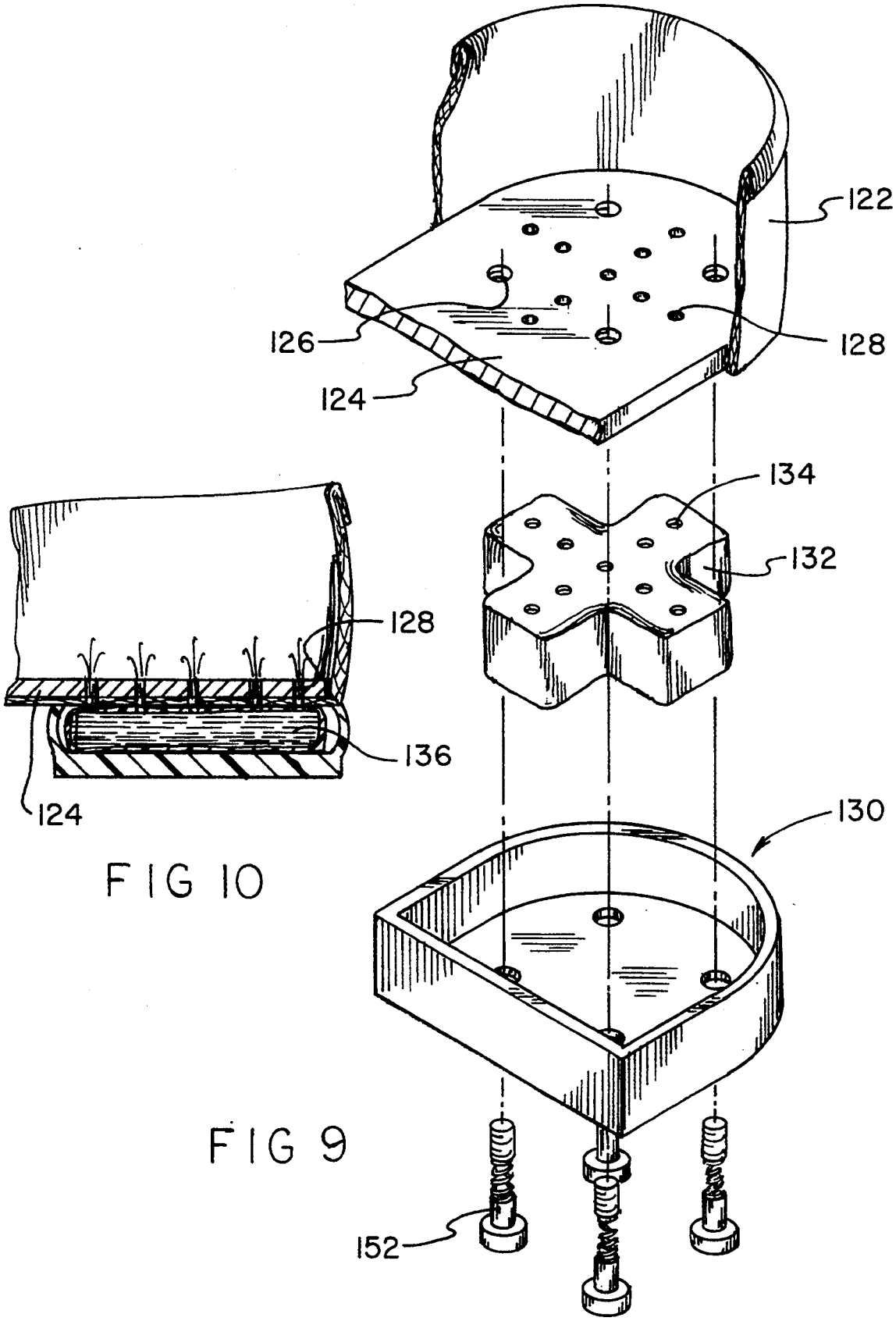
FIG. 9 is partial perspective view of the second preferred embodiment of a shoe heel replacement system with its parts separated in accordance with the present invention.
FIG. 10 is a partial cross sectional view of the second preferred embodiment in accordance with the present invention.

A second embodiment screw on heel replacement system is shown in FIGS. 5-10, particularly FIG. 9. The second embodiment screw on heel replacement system comprises a second embodiment main shoe body 122 having a sole 124 with screw holes 126 in the sole 124. Small vent holes 128 (nine shown though only one labelled) also extend through the sole 124. A hollow screw on heel 130 contains room for an addition-sign shaped powder bag 132 which could contain powdered shoe freshener or the like, such as the powder represented by reference numeral 136 in FIG. 10. The bag 132 has a plurality of holes 134 (nine holes 134 shown though only one labelled) which correspond with the holes 128 in the sole 124.

The specially constructed second embodiment screws 152 pass through the heel 130 through the space left open by the plus sign shape of the powder bag 132. The screws 152 (see FIG. 5) have a standard type head section 154 and section 156 adjacent the head 154, along with a specially adapted spring section 158 followed by a standard type threaded section 160. The spring section 158 allow the screw 152 to compress as the side walls of the heel flex, providing a softer walking feel to the wearer of the shoe.

A worn out second embodiment heel 130 is replaced in the same manner as a first embodiment heel with the addition that the powder bag 132 can be replaced while the heel 130 is off.

Figure 11:
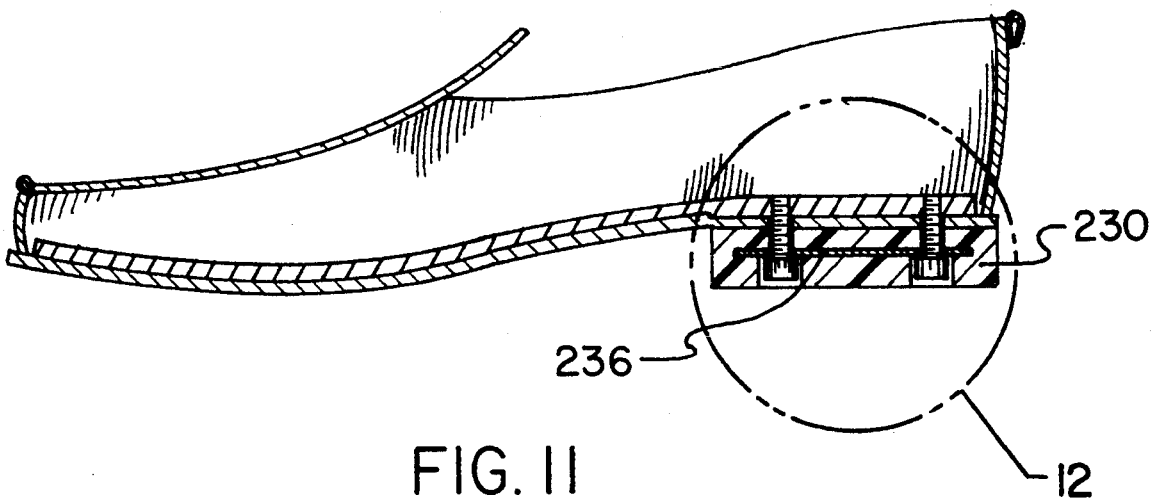
FIG. 11 is a cross sectional side view of a third preferred embodiment of the present invention.
Figure 12:
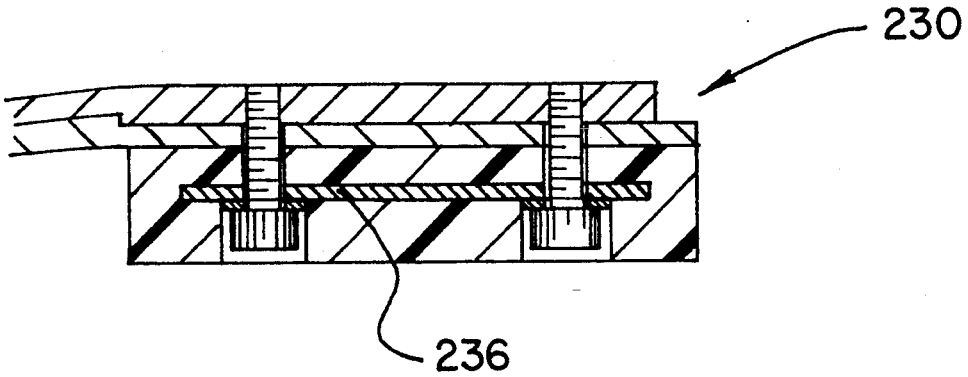
FIG. 12 is a more detailed cross sectional side view of a shoe heel for use in the third embodiment of the present invention.

A third embodiment heel 230 is shown in FIGS. 11 and 12. The third embodiment heel 230 is similar to the first embodiment with the addition of a metal plate 236 in the heel 230. The metal plate 230 can be made out of aluminum or any other suitable metal.

Using the heel replacement system of the present invention will facilitate the easy replacement of a worn heel without the need to bear the expense of professional repair. The common screwdriver and a few minutes of time are all that is required to perform the entire heel replacement job. Shoe repair has become an expensive proposition, and one bears the added inconvenience of being without a favorite pair of shoes as they await repair at the shop. The shoe repair system of the present invention addresses and eliminates these problems.

All the parts of the shoe heel replacement system of the present invention can be constructed of any suitable material. The preferred materials for the heels are hard rubber or leather.

It is apparent from the above that the present invention accomplishes all of the objectives set forth by providing a new shoe heel replacement system comprising: a shoe having a plurality of holes drilled therethrough; a plate constructed to fit within the confines of the shoe, the plate having threaded holes that, when the plate is within the shoe, correspond to the holes in the shoe; a heel having holes which, when the heel is placed under the shoe, correspond with the holes in the shoe; a plurality of threaded connecting means which can run through the holes in the heel and in the shoe and in the plate and which can be used to removably hold said heel to the plate; whereby the heel can be replaced by a new similar heel when it has worn out, the replacement requiring only a screwdriver. The plurality of threaded connecting means are preferably screws. The heel can be hollow and the screws can have spring means for flexing when pressure is placed on them. The invention can further comprising a powder bag adapted to fit within the hollow heel. The invention can further comprise a metal plate within the heel. The invention can further comprise a soft cushioning means positioned above the plate to make the shoe comfortable. The invention can also comprise a new replaceable shoe heel made up of a heel having holes which, when the heel is placed under a shoe having correspondingly drilled holes, can be screwed onto the shoe.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A shoe heel replacement system comprising:

a shoe having a main body and a sole extending along a longitudinal length of said main body to receive thereon an entire length of an individual's foot, said sole having a heel portion with a plurality of sole apertures extending through said heel portion of said sole;

an arch support plate having a shape substantially similar to said sole so as to extend coextensively thereover to substantially completely cover said sole within said shoe, said arch support plate having a heel portion with a plurality of arch support apertures extending through said heel portion of said arch support and aligned with said sole apertures, each of said plurality of arch support apertures being threaded;

a heel having a plurality of heel apertures directed therethrough, said heel apertures being aligned with said sole apertures;

a plurality of threaded screws, each of said threaded screws being directed through an individual one of said heel apertures, each of said threaded screws being further directed through an individual one of said sole apertures and threadably engaged to an individual one of said threaded arch support apertures; and, a soft cushion having a shape substantially similar to said arch support plate so as to extend coextensively thereover to substantially completely cover said arch support plate within said shoe.

2. The shoe heel replacement system of claim 1, wherein said heel includes a metal plate therewithin, said metal plate having a plurality of metal plate apertures extending therethrough and aligned with said heel apertures.

* * * * *